US007716767B2

(12) United States Patent
Böhm et al.

(10) Patent No.: US 7,716,767 B2
(45) Date of Patent: May 18, 2010

(54) DEVICE AND METHOD FOR CAREFULLY SETTLING A PATIENT IN A DEFINED POSITION

(76) Inventors: Stephan Böhm, Gruenstr. 5, 21481 Lauenburg an der Elbe (DE); Guido Kuebler, Breite Steige 13, 86399 Bobingen (DE); Fernando Suarez Sipmann, Calle Nicasio Gallego 1.4 D, 28010 Madrid (ES)

( * ) Notice: Subject to any disclaimer, the term of this patent is extended or adjusted under 35 U.S.C. 154(b) by 0 days.

(21) Appl. No.: 12/149,759

(22) Filed: May 7, 2008

(65) Prior Publication Data

US 2008/0313816 A1 Dec. 25, 2008

Related U.S. Application Data

(63) Continuation of application No. PCT/EP2006/011305, filed on Nov. 24, 2006.

(30) Foreign Application Priority Data

Nov. 25, 2005 (EP) ..... 05025833
Nov. 21, 2006 (EP) ..... 06024160

(51) Int. Cl.
*A27C 27/10* (2006.01)

(52) U.S. Cl. ..... 5/713; 5/710; 5/714

(58) Field of Classification Search ..... 5/713–714, 5/671–672, 710

See application file for complete search history.

(56) References Cited

U.S. PATENT DOCUMENTS 4,391,009 A * 7/1983 Schild et al. ..... 5/713
6,079,068 A * 6/2000 Viard ..... 5/671

FOREIGN PATENT DOCUMENTS

| | | |
|---|---|---|
| FR | 2638965 | 5/1990 |
| WO | WO 2004/082551 | 9/2004 |
| WO | WO 2004/098481 | 11/2004 |

* cited by examiner

*Primary Examiner*—Fredrick Conley
(74) *Attorney, Agent, or Firm*—Shlesinger, Arkwright & Garvey LLP

(57) ABSTRACT

The invention relates to a device and a method for the gentle placement of a patient in a defined position. In order to provide a device for the placement of patients which both allows gentle positioning and at the same time holds the patient in a defined position, the device according to the invention comprises a mattress having a surface able to adopt a flexible state, as a result of being subjected to a first control signal, and a rigid state, as a result of being subjected to a second control signal, a cushion which is filled with a fluid, rests on the mattress and comprises a flexible wall in the region of the patient or the body part of the patient resting on the cushion, and a fluid pump which is connected via a valve to the fluid in the cushion and via which the internal pressure and/or the internal volume of the cushion may be adjusted to a predetermined value.

15 Claims, 9 Drawing Sheets

DEVICE AND METHOD FOR CAREFULLY SETTLING A PATIENT IN A DEFINED POSITION

RELATED APPLICATIONS

This is a continuation application of International PCT Application No. PCT/EP2006/011305 filed Nov. 24, 2006, claiming the priority benefit of EP 05025833.4 filed Nov. 25, 2005 and EP 06024160.1 filed Nov. 21, 2006, all of which are hereby incorporated by reference.

FIELD OF THE INVENTION

The invention relates to a device and a method for the gentle placement of a patient in a defined position.

BACKGROUND OF THE INVENTION

A defined, position in the context of the invention means any position in which the patient is to remain during transport, treatment or the in-patient rest phase. Preferred positions are thus the lying and seated positions, but in principle all other positions are possible to fulfill the respective purpose.

The positioning of patients, both over relatively short periods, for example during transportation in an ambulance, and over relatively long periods, for example during the patient's stay in hospital, is an important factor for a successful treatment.

Gentle positioning of the patient is necessary in particular if problems may occur as a result of the development of pressure sores. The development of pressure sores on exposed body parts (decubitus) generally results in extended stays in hospital and increased treatment costs associated therewith. The problems of the continuous positioning of patients result from the inability of the skin to adapt to the continuous contact with the contact surface. The pressures, shear forces or moisture acting on the skin at specific points damage the skin directly or indirectly. Supply vessels are closed off by external pressure and capillaries are displaced by shear forces, and this may result in undersupplying and ultimately in these skin areas dying out. In addition, the epidermis is softened under the effect of heat and sweat, thus promoting infections.

Placement of the patient in a defined position is, again, crucial for specific treatment methods such as, for example, in modern respiratory therapies. The placement of patients in a defined position is necessary, for example, in the event of burns, injuries of the vertebral column or in respiratory therapies using a rotation bed. Fixing of the body is also necessary in the case of body positions differing from the simple back or stomach position, i.e. in positions which are not neutral with respect to the body's centre of gravity. In addition to the problem of precise therapeutic positioning, there is the further difficulty of the increase in pressure, accompanying any change in position, in the lowermost dependent body parts, with the above-described negative repercussions.

Conventional systems for fixing patients in a defined position, such as, for example, vacuum mattresses, are not suitable, for the reasons described above, for continuous positioning of the patient. Instead, vacuum mattresses are used only for short-term transportation or during an operation.

WO 2005/094369 A2 discloses a method and a device for controlling at least one ventilation parameter of an artificial ventilator for ventilating the lung of the patient in accordance with a plurality of lung positions. The various lung positions are facilitated by using a rotation bed. The patient is fixed on the rotation bed and therefore held in a defined position. One drawback, however, is the fact that gentle positioning of the patient is not facilitated.

A. Paul: More than just pressure reduction—Support surface MiS Activ, Völker World, Issue 17, 2005, pages 7-10, discloses a microstimulation system in which the slatted grid of a conventional mattress was replaced by carrier profiles with active movement elements. The movement elements are controlled by a control unit so that different movement forms on the basis of the so-called basal stimulation can be applied to the patient lying on the mattress. Examples of movement patterns are the "wave", "rotation" or "angled plane". In the "wave" pattern, the movement elements to the right and left of the mattress are activated in parallel. The stimulation pattern resembles a wave running through the bed and gives the patient a perception of movement from head to foot. In the "rotation" pattern, the movement elements right and left are activated in an offset manner. Wave peaks in opposite directions arise which correspond to a rotation. After three cycles, the direction of rotation is reversed. In the "angled plane" pattern, all movement elements of one side are activated simultaneously and thus generate this angled plane. After a selection from three prespecified time intervals, the tilt angle changes to the other side.

One disadvantage of this placement system is the fact that there is no precise fixing facility for the patient to hold the patient in a defined position. Thus in total only movement strokes of a few centimeters are possible. A greater tilt of the mattress could not be considered, in order for example to activate certain lung areas of the patient in a targeted manner.

It is therefore an object of the invention to provide a device for the positioning of patients both allowing gentle positioning and at the same time holding the patient in a defined position. This object is achieved by the device according to claim 1 and the method according to claim 10.

The device according to the invention for the gentle placement of a patient or of a body part of a patient in a defined position comprises a mattress having a surface able to adopt a flexible state, as a result of being subjected to a first control signal, and a rigid state, as a result of being subjected to a second control signal, a cushion which is filled with a fluid, rests on the mattress and comprises a flexible wall in the region of the patient or the body part of the patient resting on the cushion, and a fluid pump which is connected via a valve to the fluid in the cushion and via which the internal pressure and/or the internal volume of the cushion may be adjusted to a predetermined value.

SUMMARY OF THE INVENTION

The method according to the invention for the gentle placement of a patient positioned on the device according to invention or of a body part of a patient in a defined position comprises the following steps: subjecting the mattress to the first control signal in order to adapt the surface of the mattress to the contour of the patient, subjecting the mattress to the second control signal in order to form a rigid surface of the mattress, and activating the fluid pump to adjust a predetermined internal pressure and/or a predetermined internal volume in the cushion.

Preferred positions for placement of the patient on the device according to the invention are the lying position or the seated position. The mattress and the cushion are formed according to the desired position and taking into account the patient's body size.

According to the invention, the mattress defines a rigid form used by the cushion as an abutment. The shaping process for the mattress and for the cushion may be automated. The cushion is used for distributing the bearing forces and therefore contributes to the two-dimensional and/or punctiform relief of the skin. Furthermore, means for therapeutic and/or medical treatment may be supplied to the patient via the cushion. As the mattress already substantially defines the contour of the body, the cushion has merely to compensate relatively small degrees of unevenness.

The device according to the invention is suitable for the stationary long-term positioning of patients and also for transporting patients, where the device can be provided for example on a hospital bed for a lying position or on a wheelchair for a seated position. The overall system may be used in a fixed manner (for example, a stationary operating table, stationary couch or seat for radiographic examination or nuclear magnetic resonance tomography), be configured so as to be movable on rollers (for example, a wheelchair, bed or positioning system in a normal care unit or in an intensive care unit) or else be used in an ambulant portable form (for example, emergency medical services). The transportation of the patient may also include transportation between the different units (for example, CT, neuroradiology, etc.) within a hospital. The device according to the invention allows continuous treatment with respect to the therapeutic/medical measures required for positioning the patient. Advantages include both a reduction in problems (for example, pneumonia) resulting from repositioning and increased safety during transportation of this type. It should be noted, in this regard, that the device according to the invention for use in the diagnostic sector is made from materials which behave neutrally in relation to the diagnostic method concerned (e.g. radiographic examination or nuclear magnetic resonance tomography) and therefore have no influence on the examination.

According to an aspect of the invention, the fluid is either air or water. These two fluids are particularly advantageous in a medical environment, although in principle other gases or liquids may also be used.

According to a further aspect of the invention, active cushions, which already have a basic shape for adapting the surface of the mattress to the contour of the patient, are arranged below the mattress. Active cushions of this type are advantageously bulky in form and ideally consist of a plurality of independent chambers. The active cushions preferably already meet specific design requirements resulting from the shape of the human body. Their configuration may vary from a system for positioning the entire body, through one which encompasses only the torso, to a miniature system for positioning the extremities. The aforementioned design requirements allow the necessary thickness of the mattress to be reduced, provided that there is sufficient mouldability.

Advantageously, the active cushions are filled with or emptied of the fluid concerned under control or regulation by a control unit, to allow the pressures and/or volumes in the active cushions to be adapted to changing peripheral conditions, such as the different body weight of the patients or the inclination of the respective underlay, to be adapted. This would enable the active cushions to ensure, in addition to the patient-specific moulding, stabilisation and positioning of the mattress itself.

According to a further aspect of the invention, the surface of the mattress may be adapted, as a result of being subjected to the first control signal, to the respective contour of the patient resting thereon and the surface of the mattress having this adapted contour may be brought into a rigid state as a result of being subjected to the second control signal. This firstly produces a precise impression of the patient or the body part, and this impression is then fixed in the mattress under the effect of the second control signal. A customised abutment for the cushion to rest on is thus produced.

According to a further aspect of the invention, the mattress consists of a vacuum mattress. A vacuum mattress consists of an air-tight casing and a loose filling consisting of tiny plastics or Styrofoam balls. In the initial state, i.e. before the vacuum mattress has been evacuated, the vacuum mattress is soft and may be adapted to the contour of the patient. By drawing the air out of the vacuum mattress, the mattress becomes rigid and permanently adopts the predetermined shape. The vacuum pump, which is connected to the vacuum mattress, is activated by the first and second control signals, the first control signal causing introduction of air into the vacuum mattress and the second control signal causing drawing of air out of the vacuum mattress.

The advantages of the vacuum mattress include its reusability and its permeability to X-rays. A further advantage of the vacuum mattress consists in the fact that the patient may, in the event of an emergency, immediately be released under the effect of the first control signal (i.e. by filling the vacuum mattress with air). In addition, correspondingly small vacuum mattresses may be used to position only specific parts of a patient's body.

According to a further aspect of the invention, the cushion consists of a plurality of independent chambers. According to the invention, the internal pressure and/or the internal volume of the individual chambers is/are adjustable. Moreover, as a result of the purposeful activation of the individual internal pressures and/or internal volumes, therapeutic measures, such as, for example, purposeful applications of pressure, may be carried out in order to achieve a prophylactic antithrombotic effect. For more efficient temperature regulation, a fluid may additionally pass through certain chambers of the cushion.

Division of the cushion into several chambers can in particular serve to apply prespecified movement patterns to the patient lying thereon in a targeted manner. For this each chamber is controlled by a separate valve via a control unit so that changing the volume of each chamber as a whole gives the desired movement pattern. A preferred movement pattern can for example correspond to the human gait (cross movement) so that alternately the left arm and right foot, or the right arm and left foot, can be moved accordingly.

Applying a movement pattern via targeted control of different chambers in the cushion can be additionally supported in that the underlying mattress is divided into corresponding segments matching the chambers of the cushion, wherein these segments can also be moved by actuators. In this way it is possible to enlarge the strokes of the movement pattern in the desired direction, in order for example to achieve strokes of a few decimeters in the cross movement pattern described above.

According to a further aspect of the invention, a temperature adjustment means, which adjusts the temperature of the fluid to a predetermined value, is provided. In this case, the cushion is able to assist or perform the regulation of the skin temperature. For this purpose, the temperature of the surface of the body and/or the core of the body is measured and the temperature of the fluid is adjusted by the temperature adjustment means in such a way that a predetermined temperature of the surface of the body or of the core of the body is obtained. This allows both heating and cooling of the patient to be achieved.

According to a further aspect of the invention, the cushion comprises means for regulating the moisture content of the patient's skin and/or means for issuing active substances to the patient. The cushion is thus able to perform or assist the regulation of the skin moisture content and may at the same time issue active substances to the patient's skin at the location where they are required. Examples of this include the issuing of nitroglycerin in order to improve local blood circulation or antibiotics in order locally to treat infections. It is also conceivable that further means of this type for therapeutic and/or medical treatment are accommodated in a layer attached to the cushion, which layer is thin compared to the thickness of the cushion. These layers may purposefully be applied to the cushion for specific purposes. In the interest of cost and hygiene, disposable layers could also be used. This would allow simple and cost-effective customisation of the therapeutic and/or medical measures.

According to a further aspect of the invention, the cushion comprises sensors for determining the position of the patient and/or for calculating physiological parameters. The data obtained from the sensors for determining the position allows conclusions to be drawn as to the pressure loads on specific body parts and therefore as to the circulation of blood in the skin. Information regarding the circulation of blood in the skin may also be obtained by a thermal camera. This data may then be used to adjust pressure and/or volume in the cushion in such a way that the desired circulation of blood in the skin is achieved. The information obtained by the sensors may also allow the moisture content and the temperature of the cushion to be adjusted or additional measures to be introduced locally. In principle, a large number of different types of sensors are conceivable, depending on the respectively pursued aim of the therapy or the intended monitored variable. For example, ECG electrodes may be used for an electrocardiogram, EIT electrodes for electrical impedance tomography, or sensors for pH measurement. Like the above-described means for therapeutic and/or medical measures, these sensors may also, if necessary, be applied to the cushion in a thin layer.

The use of sensors in the cushion layer is particularly advantageous if a movement pattern is to be applied to the patient as described above. The use of pressure sensors for example makes it possible to determine the pressure exerted by the cushion layer on the patient and control the respective chambers only so that a prespecified maximum pressure is not exceeded. In addition it is possible via expansion sensors to determine the expansion of each chamber and thus control precisely the desired expansion of the chamber when activated with fluid. The use of sensors thus contributes substantially to the safety of the patient during activation of the movement patterns, as the activation measures can be permanently monitored by the sensors and undesirable loads on the patient thus avoided.

BRIEF DESCRIPTION OF THE DRAWINGS

The invention will be described hereinafter in greater detail using various embodiment examples and with reference to the accompanying drawings, in which.

DETAILED DESCRIPTION OF THE INVENTION

Figure 1:
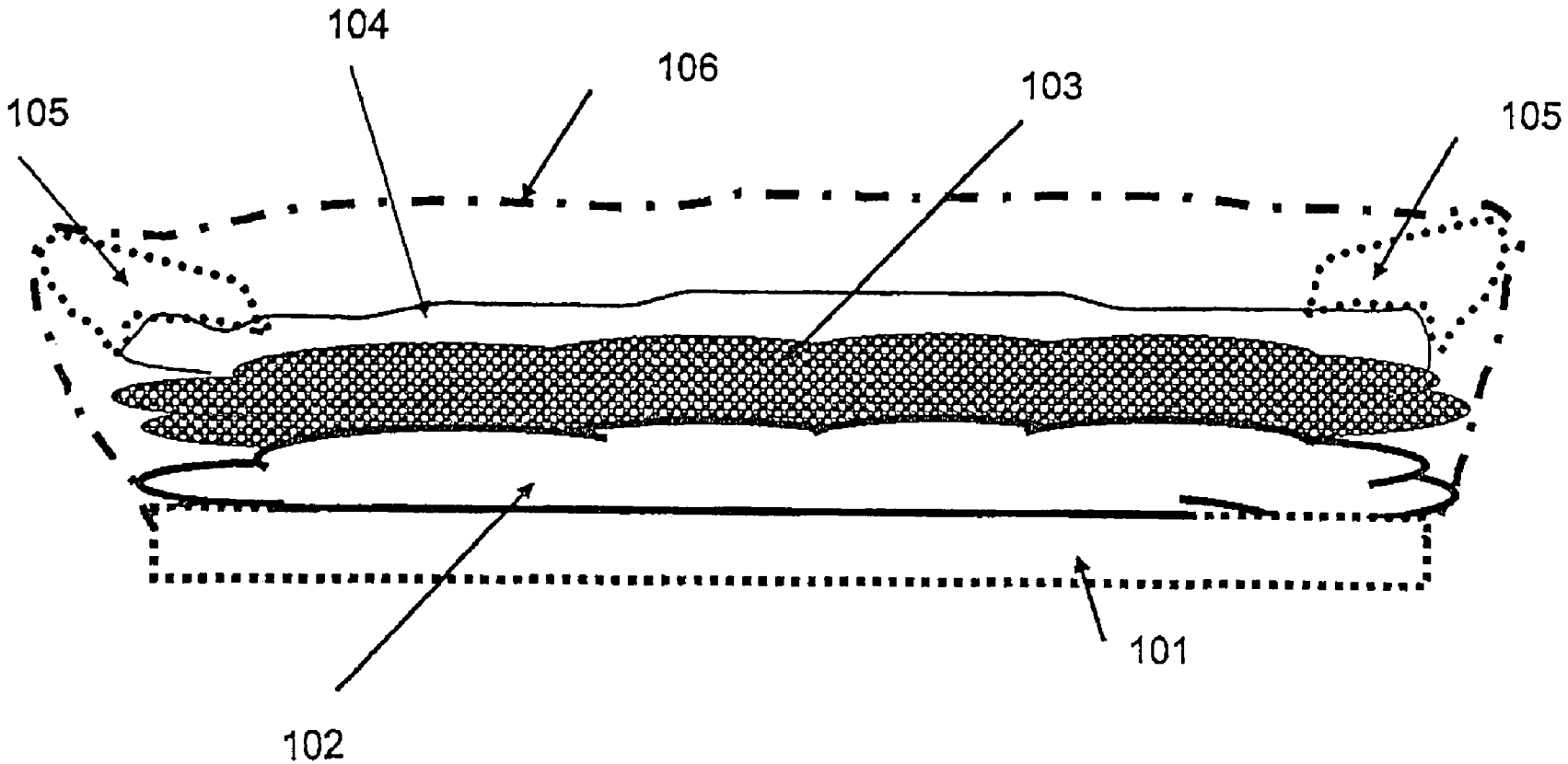
FIG. 1 is a schematic side view of the construction of the device according to the invention in an embodiment without a patient.

FIG. 1 is a schematic side view of the construction of the device according to the invention in an embodiment without a patient. In this embodiment, the device according to the invention comprises a fixed underlay 101, which may be the support of a stretcher, a normal bed or an operating table or the surface of a specific positioning system. In particular, the device according to the invention may therefore also form part of a rotation bed such as is described in WO 2005/094369 A2. In addition to the fixing, required for this purpose, of the patient in a defined position, gentle positioning is also ensured.

An active cushion 102, which in this embodiment consists of a plurality of independent chambers, is located above the fixed underlay 101. The chambers combine on their surface to form a shape approximately corresponding to the contour of a patient.

The active cushion 102 is used primarily for the patient-specific moulding of the mattress 103 resting thereon, which in this embodiment consists of a vacuum mattress. Under the effect of the first control signal, the vacuum mattress is in a flexible state and may then be optimally adapted, by activation of the active cushions 102, to the contours of the patient's body. Under the effect of the second control signal, the vacuum mattress is then made rigid. An impression of the contour of the patient or of a body part of the patient, which is used as a customised abutment for the cushion 104 attached to the mattress 103, is thus produced.

The device according to the invention illustrated in FIG. 1 is configured for positioning the entire body of the patient. However, as mentioned above, it is also possible to position only specific parts of the patient's body using the device according to the invention. The shape of the active cushion 102 may then vary depending on the field of application.

The filling or emptying of the active cushions with the fluid is controlled by a control unit in order to adapt the pressures and/or volumes in the active cushions to the changing peripheral conditions, such as for example a varying body weight of patients or the angle of the underlay concerned.

The cushion 104, arranged above the mattress 103, performs important functions of the human skin such as the regulation of moisture content and temperature. At the same time, it distributes the bearing pressure and therefore leads to two-dimensional and/or punctiform relief.

It is possible to divide the cushion 104 into a plurality of chambers, wherein the chambers may, as in the case of the active cushion 102, be filled with air. For more efficient temperature regulation, a fluid may additionally pass through the chambers. The mattress 103 already defines a body contour. The cushion 104 therefore has merely to compensate relatively small degrees of unevenness. In addition, a further basic feature of the cushion 104 is the use thereof for therapeutic purposes: for example, by the purposeful application of pressure, a prophylactic antithrombotic effect is achieved, or active substances (for example, nitroglycerin in order to improve local blood circulation or antibiotics in order locally to treat infections, etc.) are issued to the skin and the tissue located therebelow. In addition, targeted control of the volumes in the individual chambers of the cushion 104 allows a movement pattern to be applied to the patient with which a therapeutic objective can also be achieved.

The cushion 104 is also used for monitoring body states and functions: electrodes are integrated for ECG or impedance functions; pressure, temperature and moisture sensors provide information regarding the local state of the skin; pH measurements determine whether the barrier function of the skin and the circulation of blood therein are still intact.

According to this embodiment, further air cushions 105 are provided for fixing individual body parts, in case the positioning system is tilted out of the neutral positions, for example on rotation about the longitudinal axis. The air cushions 105 are filled or evacuated as a function of position and may be connected both to all or some of the layers located therebelow and to a belt 106 encircling them. The belt 106 helps to increase the safety of the overall system in that it encircles a plurality of layers, thus preventing the patient from falling out in the event of failure of individual parts or of the overall system. At the same time, this belt must be easily detachable in order to approach the patient's body as quickly as possible in the event of an emergency.

The side view of the embodiment according to FIG. 1 shows the device according to the invention in a neutral state without a patient. The vacuum mattress 103 used in this state has not yet been evacuated and the active cushions 102 located therebelow are subjected to a low pressure. For moulding the vacuum mattress, the balls in the vacuum mattress 103 are first distributed uniformly by vibration of the active cushions 102. The patient is then placed onto the cushion 104. Before the mattress is moulded to the patient by activation of the active cushions 102, the cushion 104 is filled uniformly with air in order to ensure a defined distance between the patient and mattress 103 during moulding of the mattress. Above all, care should be taken to ensure sufficient lateral enclosure of the patient. Once this enclosure has been achieved, the vacuum mattress 103 is evacuated and therefore fixed in its shape.

Figure 2:
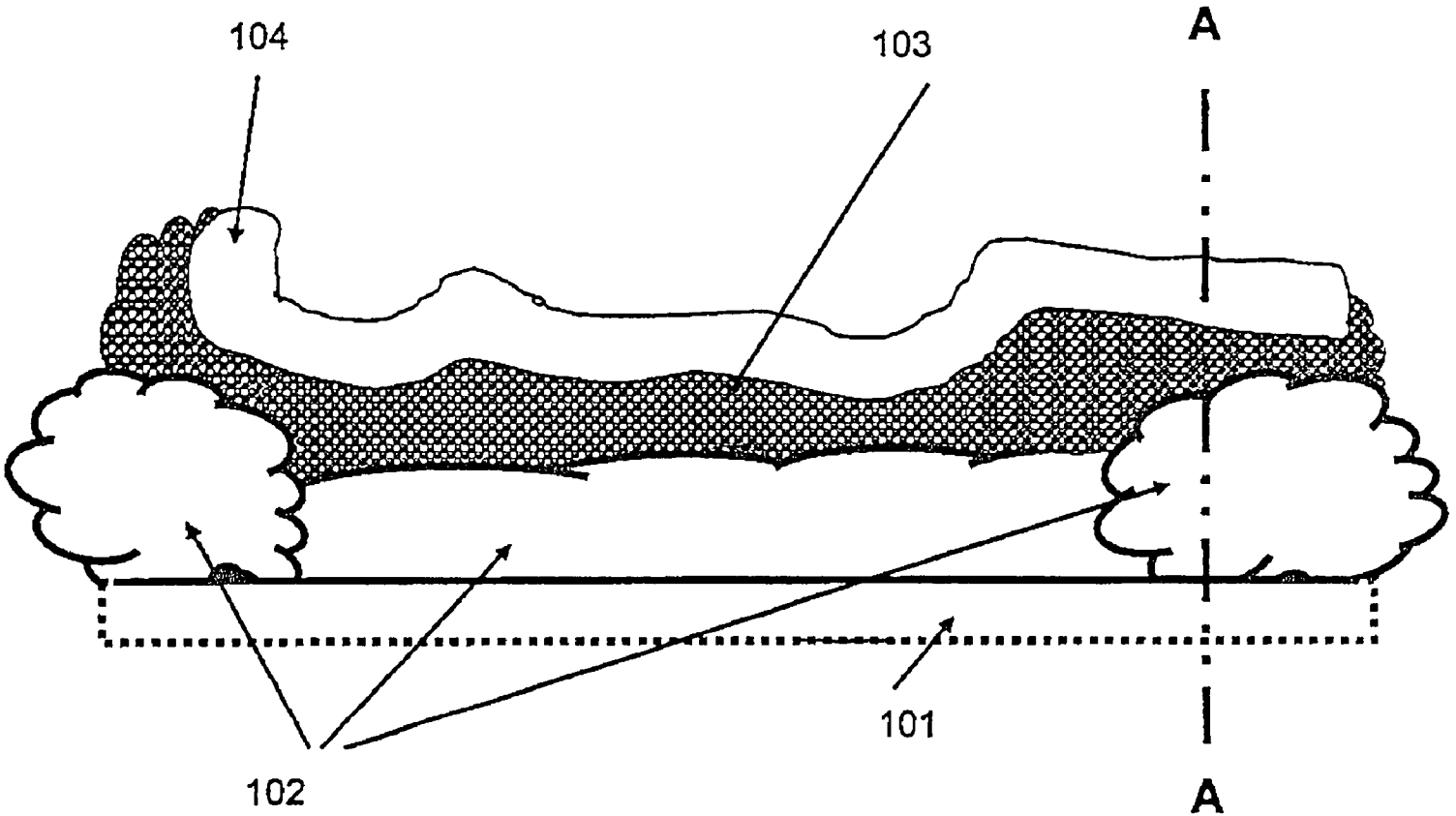
FIG. 2 is a schematic view of a central longitudinal section through the device according to the invention in the embodiment from FIG. 1 (section B-B in FIG. 3)
Figure 3:
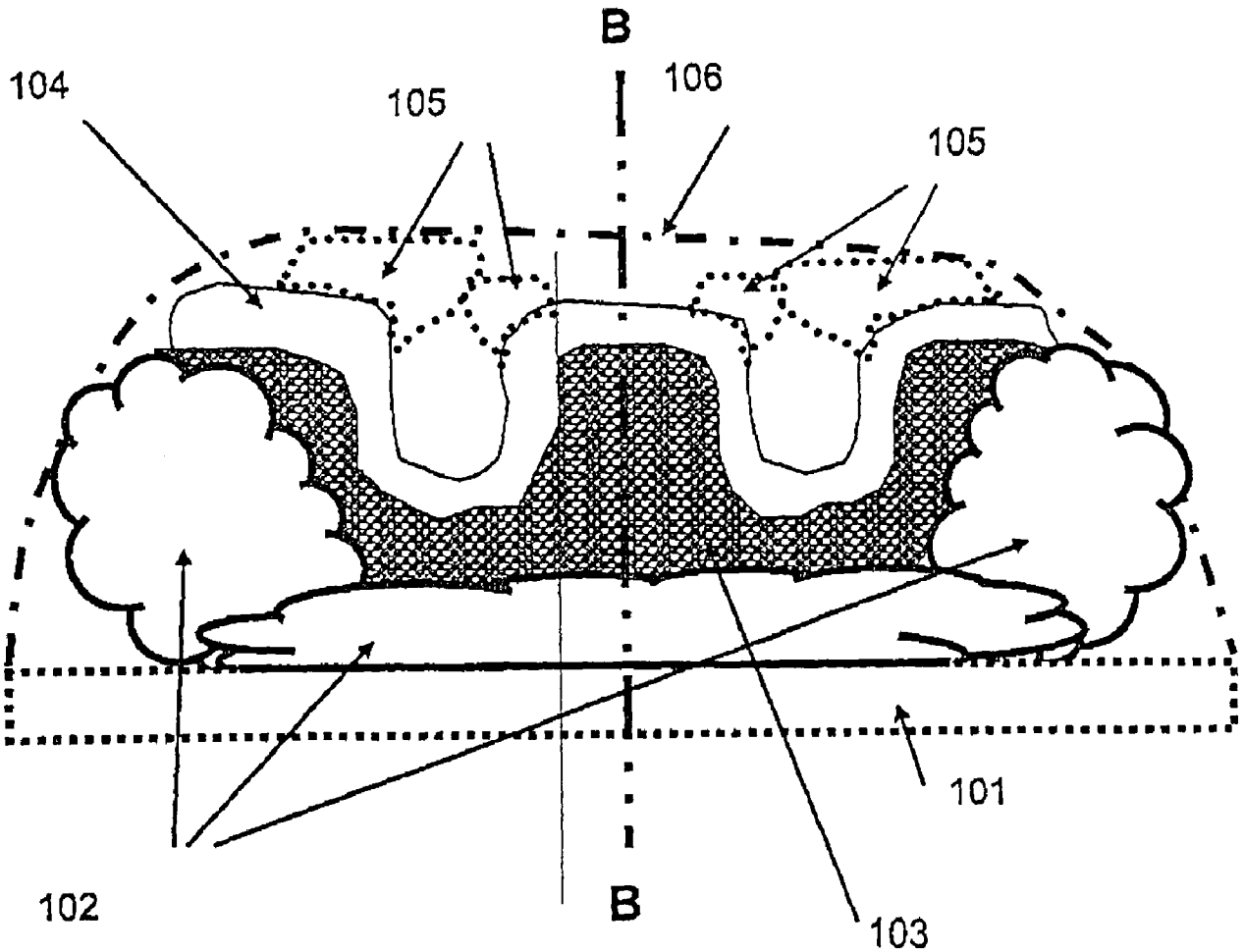
FIG. 3 is a schematic view of a cross section through the device according to the invention in the embodiment from FIG. 1, at the height of the patient's lower leg (section A-A in FIG. 2)

FIG. 2 is a schematic view of a central longitudinal section through the device according to the invention in the embodiment from FIG. 1 (section B-B in FIG. 3). This view shows the state once the mattress 103 has been moulded to the patient, the patient himself not being shown.

As soon as the vacuum mattress 103 has been fixed, the therapeutic positioning measures using the cushion 104 may commence. Firstly, the systematic release of pressure from endangered body regions (coccyx, pelvis and femur, scapulae, vertebral column) is central to any positioning therapy; further treatment aims, such as temperature management or drying of the skin, may be monitored simultaneously or sequentially.

The overall system is configured in such a way that optimally rapid treatment of the patient (for example, reanimation by defibrillation) may be ensured in the event of an emergency. A "quick-release function" thus ensures that all of the pneumatically operated excess pressure layers are discharged immediately and the vacuum mattress is actively filled.

FIG. 3 is a schematic view of a cross section through the device according to the invention in the embodiment from FIG. 1, at the height of the patient's lower leg (section A-A in FIG. 2). This view shows the state after the patient has been placed onto the device, the body of the patient himself not being shown.

The air cushions 105 and 301, illustrated using dotted lines, are used to fix the legs in order to prevent them from falling out if the device according to the invention is tilted out of the normal position. If necessary, for example if the fixed underlay 101 is part of a rotation bed and the measured angle of inclination exceeds a predetermined value, the cushions are filled with air.

In summary, an exemplary use of a device according to the invention comprising a vacuum mattress may be described by the following steps:

1. Ventilation of the vacuum mattress: the ventilation of the vacuum mattress corresponds to the effect of the first control signal. The vacuum mattress accordingly becomes soft and mouldable.
2. Shaking of the vacuum mattress: this step aims to achieve a uniform distribution of the balls in the vacuum mattress, i.e. a constant thickness of the vacuum mattress is preferably produced. The shaking may either take place manually or automatically, for example by vibrating the vacuum mattress using active cushions or other devices located therebelow.
3. Positioning of the patient: the patient is placed onto the cushion.
4. Filling of the cushion: in order to define the distance between the patient and the vacuum mattress, the internal pressure of the cushion and/or the internal volume of the cushion is/are adjusted to a predetermined first value. This step subsequently ensures a defined distance between the vacuum mattress and the patient during moulding of the vacuum mattress.
5. Moulding of the vacuum mattress: the vacuum mattress is moulded, in view of the spacing provided by the cushion, to the patient's body and therefore assumes a body-specific contour. The moulding of the vacuum mattress may either take place manually or else the active cushions arranged below the vacuum mattress may be used in order to adapt the vacuum mattress to the contour of the body.
6. Fixing of the vacuum mattress: the vacuum mattress is fixed in the moulded shape and therefore assumes a rigid state. The fixing of the vacuum mattress is brought about under the effect of the second control signal.
7. Adaptation of the pressure/volume of the cushion: the internal pressure of the cushion and/or the internal volume of the cushion is/are adjusted to a predetermined second value. The aim is then to achieve gentle positioning of the patient's body. The fixed vacuum mattress then serves the cushion as an abutment.
8. Therapeutic/medical measures: measures of this type may be carried out via the cushion by purposefully adjusting parameters such as, for example, pressure, volume, moisture content or temperature of the surface of the cushion. Test results from sensors located in the cushion are preferably processed for this adjustment. For example, position sensors or thermal cameras may indicate insufficient circulation of blood and, as a countermeasure, the pressure in corresponding chambers of the cushion may be adapted in order to improve the circulation of blood. The adjustment of pressure and volume for adjusting the circulation of blood in combination with the defined abutment for the vacuum mattress leads, in particular, to an optimal result.
9. Application of a movement pattern via the cushion layer, where the cushion comprises several independent chambers for this purpose. The chambers are activated by means of a control unit via valves provided to that end, wherein additionally sensors can be provided to monitor the activation or regulate this in a targeted manner. A preferred movement pattern is the cross movement of human gait.

Figure 4:
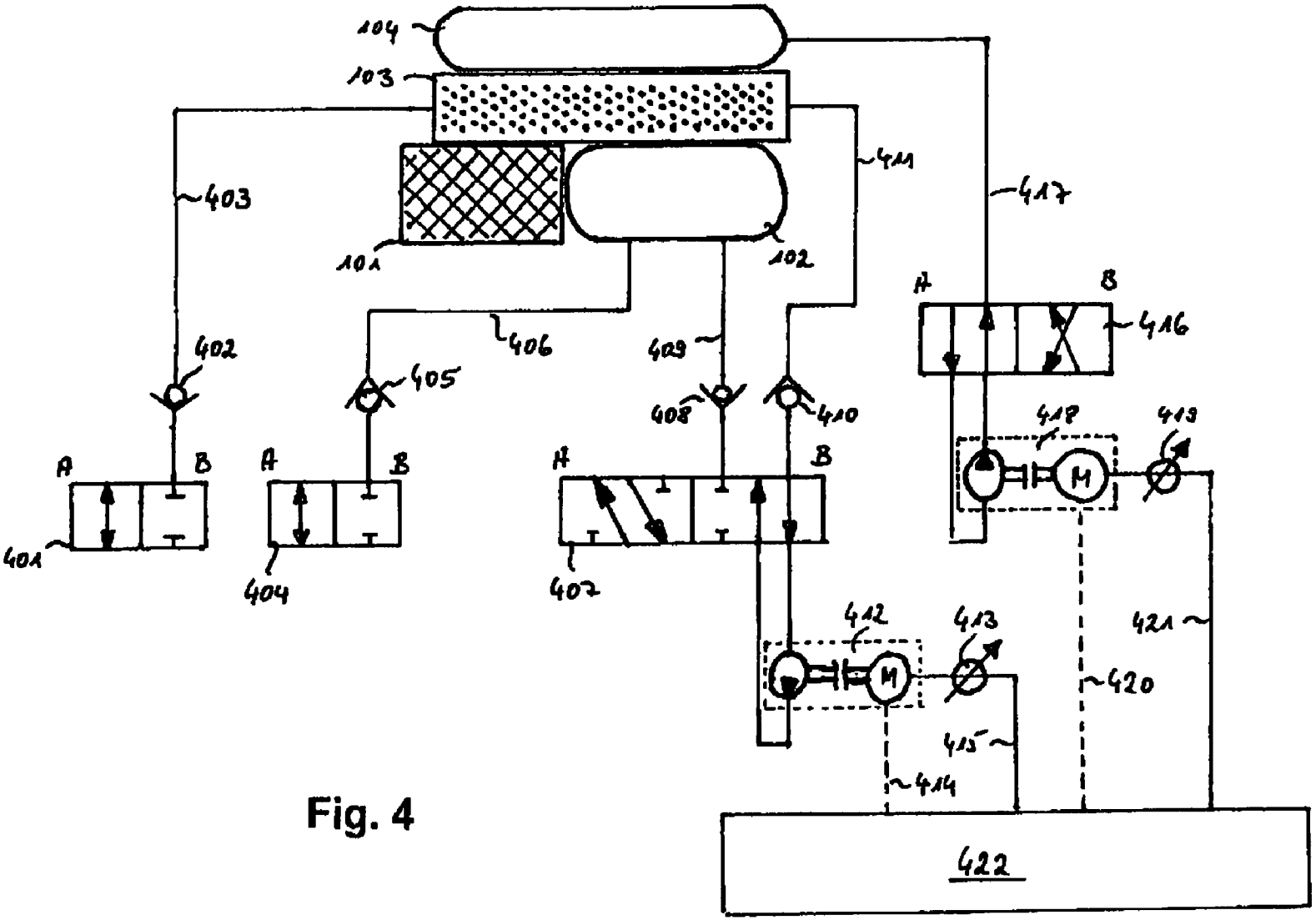
FIG. 4 is a pneumatic circuit diagram of the device according to the invention.

FIG. 4 shows the pneumatic circuit diagram for the device according to the invention, for example according to the embodiment example in FIGS. 1 to 3. The fixed underlay 101, the active cushion 102, the vacuum mattress 103 and the fluid-filled cushion 104, are depicted schematically. Air is used as a fluid. For filling and evacuation of the active cushion 102, the vacuum mattress 103 and the cushion 104, two pumps 412 and 418 are provided which are connected with a control unit 422 via control lines 414 and 420. In principle the same function can also be achieved with a pump, wherein the pneumatic circuit diagram must then be modified accordingly using additional switching points. The pneumatic switching processes are performed via the fill valve 401, the evacuation valve 404, the change-over valve 407 and the reversing valve 416. For activation, all active valves are connected with the control unit 422 via control lines not shown further. In contrast, the non-return valves 402, 405, 408 and 410 work passively and thus require no further control. The power is supplied to the pumps 412 and 418 via lines 415 and 421, wherein the power consumption of the pumps is measured with the power meters 413 and 419.

The function sequence described below relates to the transport of a patient who must be placed gently during transport.

First the active cushion 102 and cushion 104 are evacuated and the vacuum mattress 103 filled.

To evacuate the active cushion 102, the pump 412 is switched off, the evacuation valve 404 is in position A and the change-over valve 407 is in position B. The positive pressure line 409 is blocked by the change-over valve 407 so that air can escape via the evacuation line 406, the non-return valve 405 and the evacuation valve 404.

To fill the vacuum mattress 103, pump 412 is switched off, the fill valve 401 is in position A and the change-over valve 407 in position B. Thus the fill line 403 is cleared via the fill valve 401 and the non-return valve 402, so that the vacuum mattress 103 can be filled with the necessary air quantity to assume a flexible state.

To evacuate the cushion 104, the reversing valve 416 is in position B so that pump 418 is operated as a vacuum pump and via pressure line 417 the excess air is extracted from the cushion 104. As soon as the pump power measured by the power meter 419 exceeds a prespecified value, the pump 418 is switched off again via the control line 420.

In the next step, the patient (or only a particular body part of the patient) is laid on the cushion 104 and via the active cushion 102, the vacuum mattress 103 is deformed. For this the evacuation valve 404 is in position B and the change-over valve 407 in position A so that the active cushion 102, on activation of the pump 412, is filled with air via the non-return valve 408 and the positive pressure line 409. As soon as the pump power measured by the power meter 413 exceeds a prespecified value, the pump 412 is switched off again via the control line 414. If necessary a further deformation of the vacuum mattress 103 can be made manually by the care staff.

In a next step, the vacuum mattress 103 is put into a rigid state. For this the fill valve 401 is in position B and the change-over valve 407 in position B, so that the air in the vacuum mattress 103, on activation of the pump 412, is extracted via the non-return valve 410 and the reduced pressure line 411. As soon as the pump power measured by the power meter 413 exceeds a prespecified value, the pump 412 is switched off again via the control line 414.

In a last step, the internal pressure and/or internal volume of the cushion 104 is set to a prespecified value so that the patient can be placed gently as a whole and at the same time is placed in the position defined by the vacuum mattress 103. For this the reversing valve 416 is in position A, so that the pump 418 is operated as a pressure pump and via the pressure line 417 the cushion 104 is filled with air. As soon as the pump power measured by the power meter 419 exceeds a prespecified value, the pump 418 is switched off again via the control line 420.

With the pneumatic circuit diagram according to FIG. 4, a relatively simple pneumatic circuit can be implemented which is adequate for transport purposes. If however the above-mentioned movement patterns are to be applied to the patient via the cushion 104, the cushion 104 must then usually be divided into several independent chambers and also the filling and evacuation of the cushion 104 must be monitored by corresponding sensors so that the desired therapeutic measures can be performed precisely.

Figure 5:
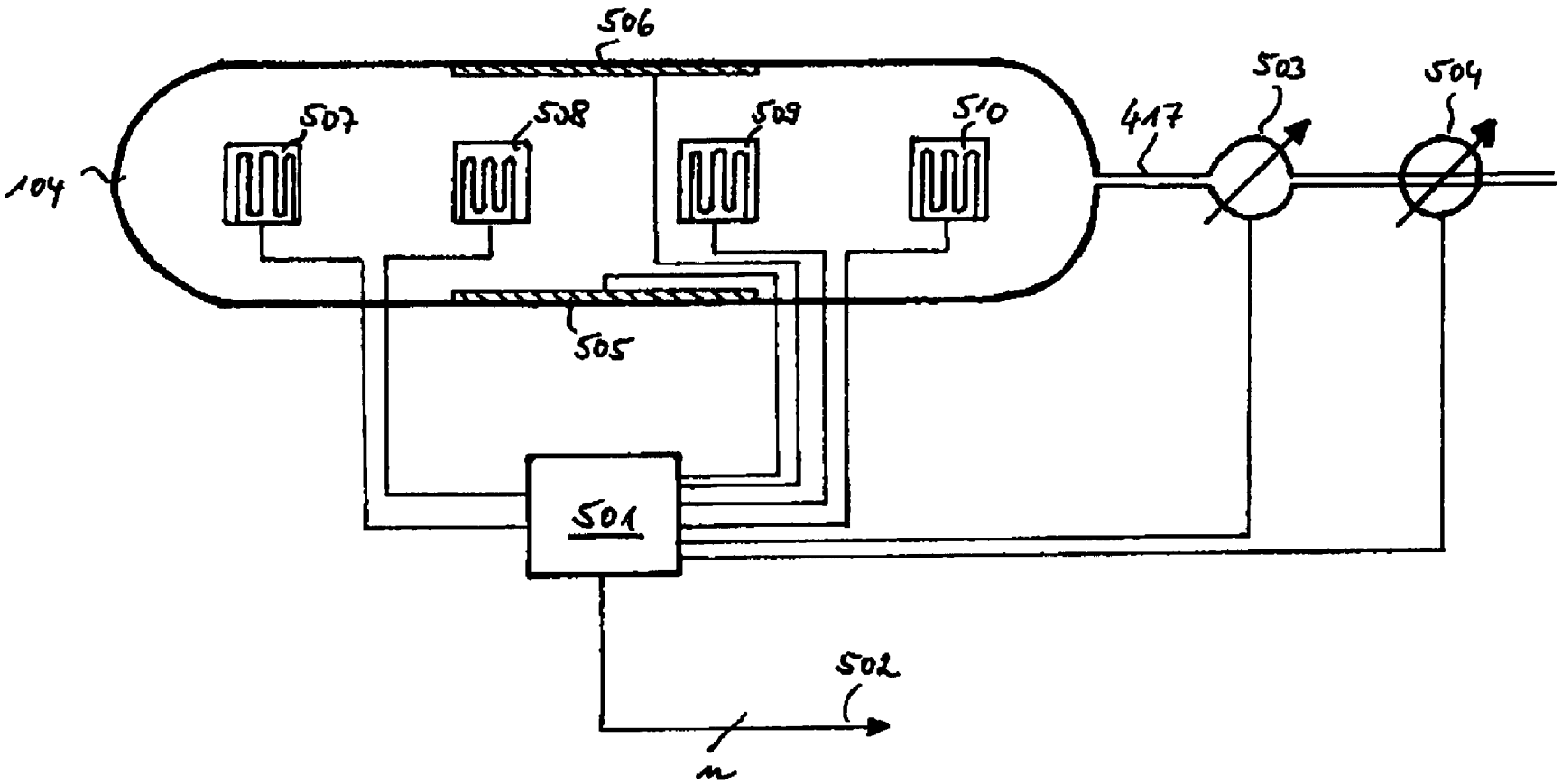
FIG. 5 shows the connection of sensors on a cushion according to FIG. 4 for performance of targeted therapeutic measures.

FIG. 5 shows the connection of sensors on a cushion according to FIG. 4 for performance of targeted therapeutic measures. All sensors are connected to an analog-digital converter 501. The sensor data are detected by the analog-digital converter 501 as digital data, and transmitted via the databus 502 with bus width n to a control unit for processing. The pneumatics can for example be further controlled according to the pneumatic circuit diagram in FIG. 4.

Provided as sensors according to FIG. 5 are a pressure sensor 503, a volume sensor 504, a distance sensor 505, 506 and one or more expansion sensors 507, 508, 509, 510. The distance sensor here comprises condenser plates 505 and 506, expansion strips 507, 508, 509, 510 are provided as expansion sensors. All sensors can be used individually and/or in combination for permanent monitoring of the pneumatic state and/or feed-back control of the filling and evacuation of the cushion 104.

For monitoring the pneumatic state, preferably the pressure sensor 503 and expansion sensors 507, 508, 509, 510 are used. Using pressure sensor 503, in particular the seal of the cushion 104 can be verified in that the pressure of the filled cushion 104 is monitored. The expansion sensors 507, 508, 509, 510 can be applied to suitable points so that the expansion of the cushion 104 on filling can be monitored in order to prevent over-expansion by automatic disconnection of the fluid pump concerned. Correspondingly the pressure sensor 503 on filling the cushion 104 can be used automatically to prevent any over-pressure in the cushion 104.

For feed-back control of the filling and evacuation of the cushion 104, preferably the distance sensors 505, 506 and volume sensor 504 are used. After the cushion 104 has been evacuated completely, the cushion 104 can be filled via volume sensor 504 with a prespecified volume of air. Different volume quantities cause a different degree of lift of the patient lying thereon, so that already specific movement patterns can be applied to the patient in a targeted manner via the cushion 104. A more precise setting of the movement pattern can be achieved with the distance sensor 505, 506 wherein the distance of condenser plates 505 and 506 is evaluated via a calculation unit not shown in detail.

Figure 6:
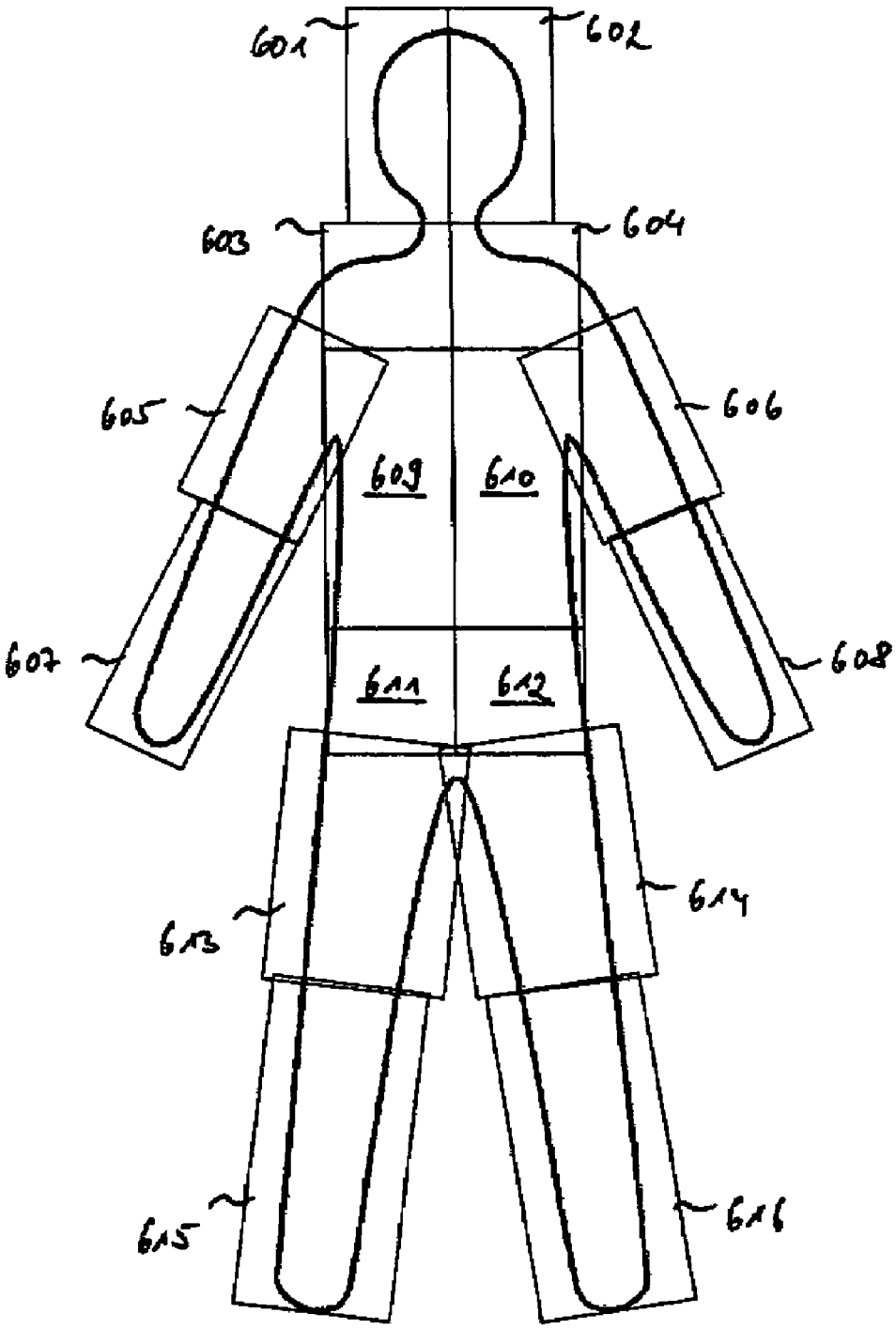
FIG. 6 shows several cushion segments for targeted stimulation of the patient lying thereon with prespecified movement patterns.

FIG. 6 shows several cushion segments for targeted stimulation of the patient lying thereon with prespecified movement patterns. In total 16 cushion segments are provided, namely the segments 601, 602 in the head area, segments 603, 604 in the shoulder area, segments 609, 610, 611 and 612 in the lumbar area, segments 605, 607 and 606, 608 in the arm area, and segments 613, 615 and 614, 616 in the leg area. For placement of the patient, in principle again the device according to FIGS. 1-3 is used, wherein cushion 104 is now divided into individual segments 601-616. The pneumatics can in principle be controlled with the pneumatic circuit diagram according to FIG. 4, wherein for each segment 601-616 a separate control and regulation system is provided with corresponding sensors according to FIG. 5.

Figure 7:
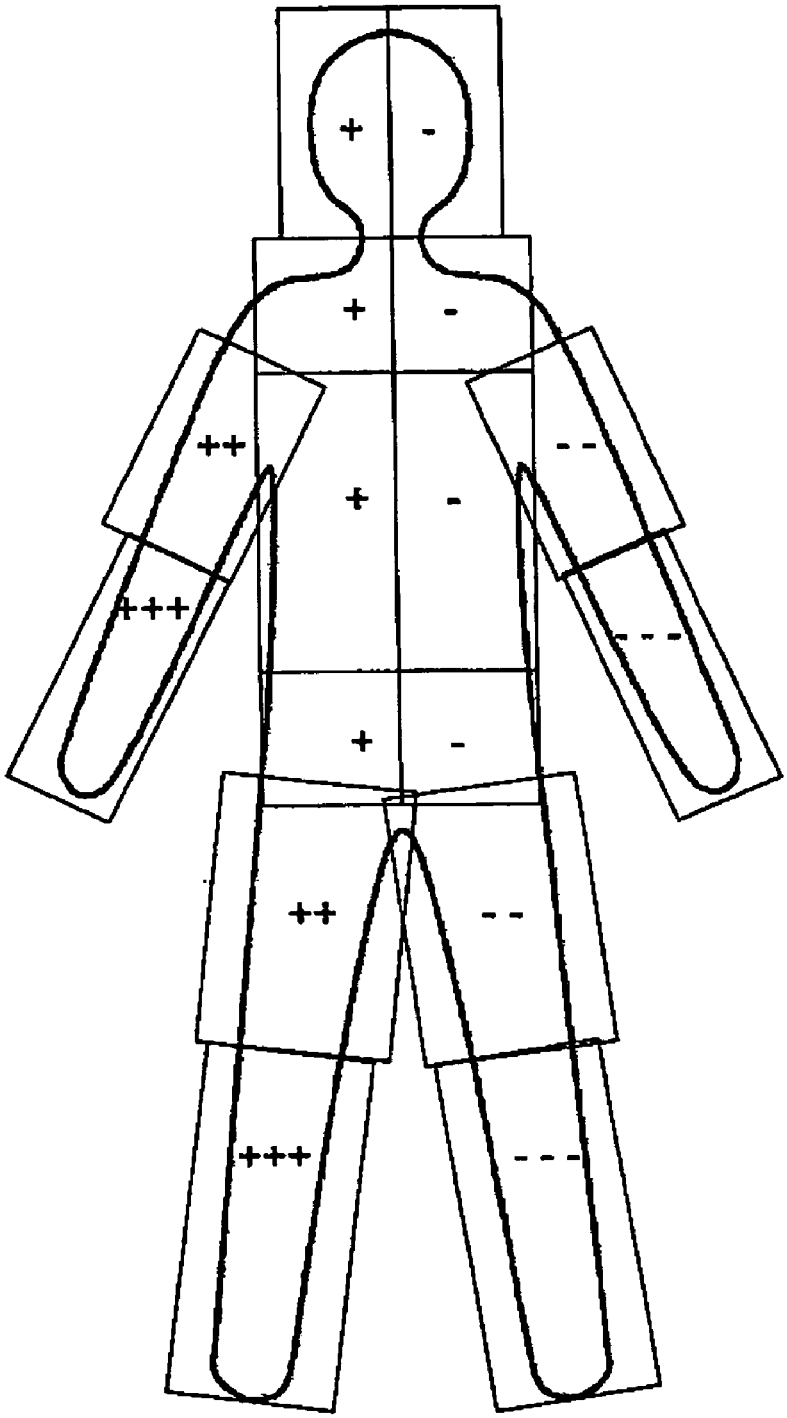
FIG. 7 shows a first movement pattern of the cushion segments according to FIG. 6.

FIG. 7 shows a first movement pattern of the cushion segments according to FIG. 6. In this movement pattern, the right body half of the patient is raised and the left body half of the patient is lowered. The depiction in FIG. 7 is based on a neutral position in which all segments are filled with a medium volume and thus for all segments a medium distance has been set from the vacuum mattress 103 below. In relation to the neutral state, "+++" symbolizes a strong fill, "++" a moderate fill and "+" a slight fill, and correspondingly "−−−" a strong evacuation, "−−" a moderate evacuation and "−" a slight evacuation. When a distance sensor is used for each segment, a corresponding distance can be allocated to each symbol "+++", "++", "+", "−−−", "−−", "−", so that including the rest position, in total each segment can have 7 different heights. If we assume for example that the maximum lift of a cushion segment from the underlying vacuum mattress is 6 cm, then a segment can be set at distances 0 cm, 1 cm, 2 cm, 3 cm, 4 cm, 5 cm and 6 cm (disregarding the wall thickness of the cushion 104). If the maximum lift of a cushion segment however is only 3 cm, a segment can be set correspondingly to distances 0.0 cm, 0.5 cm, 1 cm, 1.5 cm, 2 cm, 2.5 cm and 3.0 cm.

Figure 8:
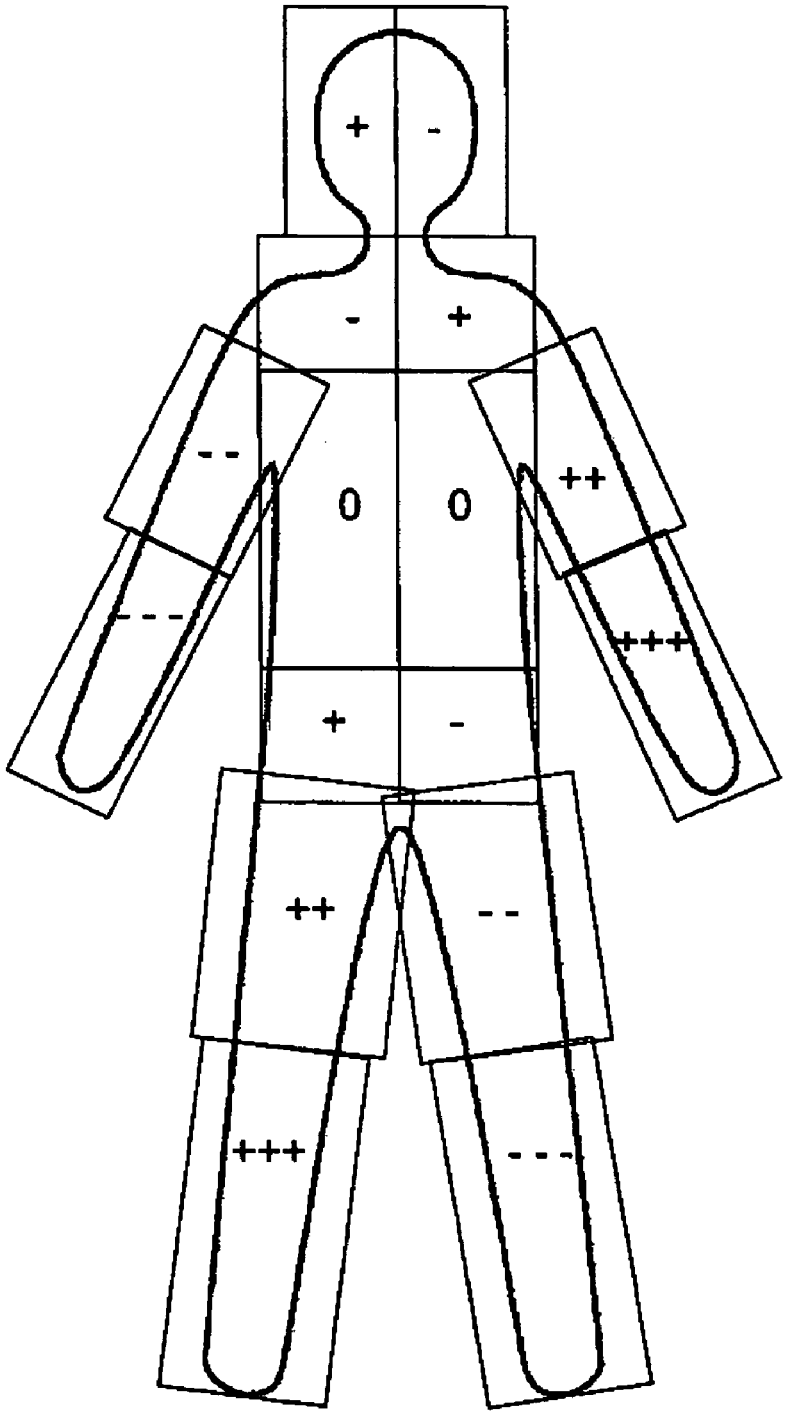
FIG. 8 shows a second movement pattern of the cushion segments according to FIG. 6.

FIG. 8 shows a second movement pattern of the cushion segments according to FIG. 6. In this movement pattern, the human cross movement according to the normal human gait is simulated. The symbol "0" for segments 609 and 610 indicates that these segments remain in the neutral position and consequently cannot be activated. Otherwise the segments are activated periodically. As shown for example first the left arm and the right leg are raised and at the same time the right arm and left leg lowered, then the opposite movement occurs in a corresponding manner.

Figure 9:
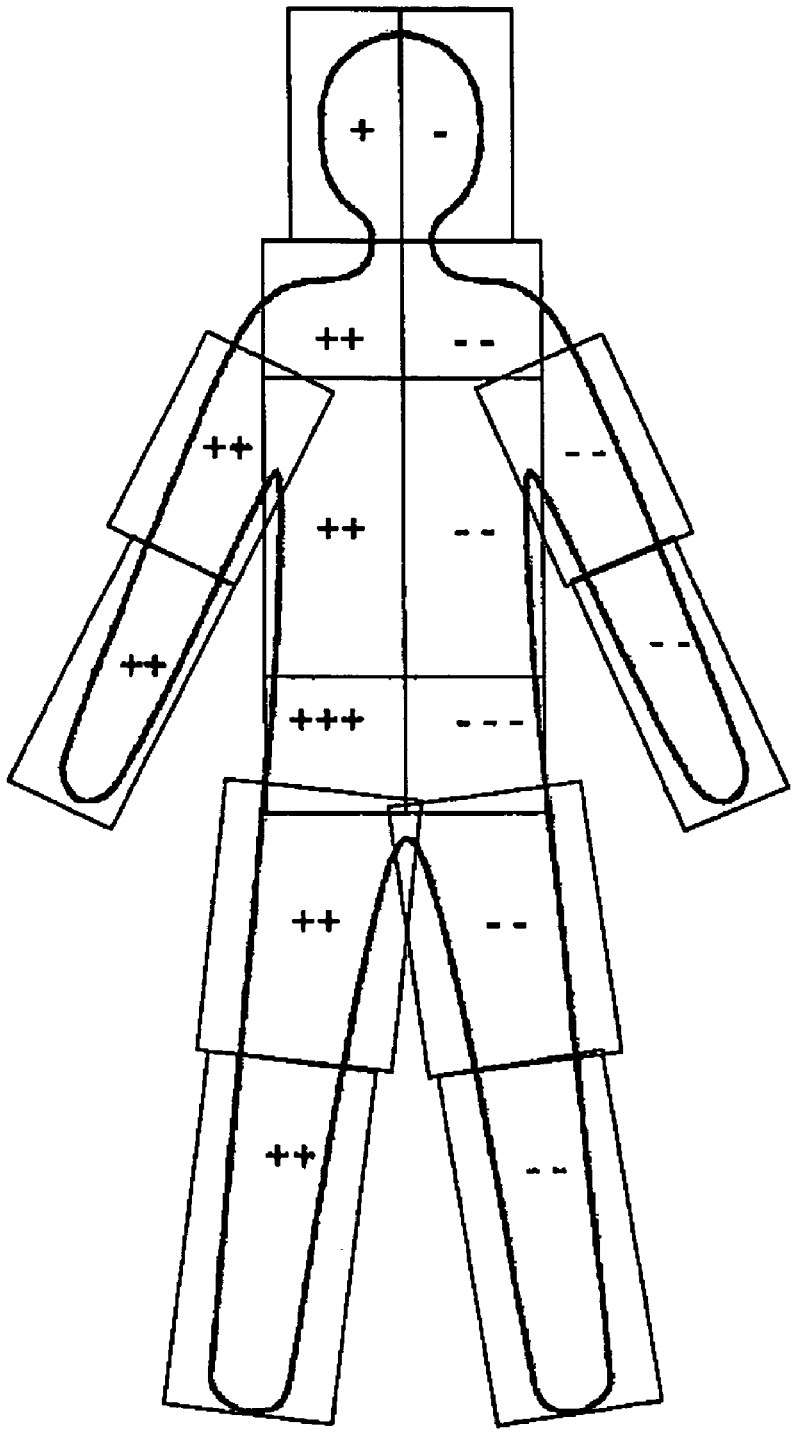
FIG. 9 shows a third movement pattern of the cushion segments according to FIG. 6.

FIG. 9 shows a third movement pattern of the cushion segments according to FIG. 6. This movement pattern is advantageous if the overall position of the patient is changed from the outside, for example as takes place on tilting of the entire bed of the patient about the longitudinal axis in accordance with WO 2005/094369 A2. In such tilt movements, in the area of the lower-lying cushion segments greater weight loading occurs due to the body weight of the patient than in the higher-positioned cushion segments. To compensate for these uneven loads, the internal pressure in the cushion segments can be adjusted accordingly. If for example the patient with his entire bed is tilted about the longitudinal axis and thus the right body half lowered and the left body half raised, then the imbalance in the individual cushion segments caused by this tilting can be compensated again by the movement pattern according to FIG. 9. With this movement pattern however not only is the tilting of the entire system compensated, but the placement conditions for the lying patient can be adapted in this way only as required.

For all movement patterns, it is conceivable that in addition the control unit takes into account the patient's subjective evaluation. For this, the patient has an input unit, for example with the buttons "positive", "neutral" and "negative". On corresponding request, the patient presses a button according to his perception triggered by the movement pattern. The control unit can then, using an adaptive learning algorithm, on the basis of the patient's assessment, vary and adapt the frequency and changing of the movement patterns accordingly.

REFERENCE LIST

101 Fixed underlay
102 Active cushion
103 Mattress
104 Cushion
105 Air cushion
106 Belt
401 Fill valve
402 Non-return valve
403 Fill valve
404 Evacuation valve
405 Non-return valve
406 Evacuation line
407 Change-over valve
408 Non-return valve
409 Positive pressure line
410 Non-return valve
411 Reduced pressure line
412 Pump
413 Power meter
414 Control line
415 Power supply
416 Reversing valve
417 Pressure line
418 Pump
419 Power meter
420 Control line
421 Power supply
422 Control unit
501 Analog-digital converter
502 Databus
503 Pressure sensor
504 Volume sensor
505 Condenser plate for distance sensor
506 Condenser plate for distance sensor
507 Expansion measurement strip for expansion sensor
508 Expansion measurement strip for expansion sensor
509 Expansion measurement strip for expansion sensor
510 Expansion measurement strip for expansion sensor

We claim:

1. Device for gentle placement of a patient or of a body part of the patient in a defined position, comprising:

a mattress having a surface able to adopt a flexible state, as a result of being subjected to a first control signal, and a rigid state, as a result of being subjected to a second control signal, a cushion filled with a fluid resting on the mattress to provide a flexible wall in a region of the patient or the body part of the patient resting on the cushion, a fluid pump which is connected via a valve to the fluid in the cushion and via which the internal pressure or the internal volume of the cushion is adjusted, and at least one active cushion arranged below the mattress and which is filled with a fluid, whose internal pressure or internal volume is adjusted to shape the mattress in the flexible state to the contour of the patient.

2. Device according to claim 1, wherein the fluid is either air or water.

3. Device according to claim 1, wherein the mattress includes a vacuum mattress.

4. Device according to claim 1, wherein the cushion includes a plurality of independent chambers.

5. Device according to claim 1, wherein the cushion includes a temperature adjustment means, which adjusts the temperature of the fluid to a predetermined value.

6. Device according to claim 1, wherein the cushion comprises means for regulating the moisture content of the patient's skin.

7. Device according to claim 1, wherein the cushion comprises sensors for determining the position of the patient.

8. Device according to claim 1, wherein the cushion comprises sensors for determining states of pressure between the mattress and the patient.

9. Device according to claim 1, wherein the cushion comprises a plurality of independent chambers and a control unit to apply a movement pattern to the chambers for stimulation of the patient lying on the mattress via corresponding valves.

10. Device according to claim 1, wherein the active cushion includes a plurality of independent chambers.

11. Device according to claim 1, wherein the cushion comprises sensors for determining states of expansion between the mattress and the patient.

12. Device according to claim 1, wherein the cushion comprises sensors for determining distance between the mattress and the patient.

13. Device according to claim 1, wherein the cushion comprises sensors for calculating physiological parameters.

14. Device according to claim 1, wherein the cushion comprises means for issuing active substances to the patient.

15. Method for gentle placement of a patient or of a body part of the patient in a defined position, comprising the steps of:

providing a mattress having a surface able to adopt a flexible state, as a result of being subjected to a first control signal, and a rigid state, as a result of being subjected to a second control signal, providing over the mattress a cushion which is filled with a fluid, providing underneath the mattress at least one active cushion which is filled with a fluid, subjecting the mattress to the first control signal in order to put the mattress in the flexible state, adjusting the internal pressure or the internal volume of the cushion to a first predetermined value for ensuring a defined distance between the mattress and the patient, adjusting the internal pressure or internal volume of the at least one active cushion for adapting the surface of the mattress to the contour of the patient lying on the mattress, subjecting the mattress to the second control signal in order to put the mattress in the rigid state, and adjusting the internal pressure or the internal volume of the cushion to a second predetermined value for obtaining a gentle placement of the patient.

* * * * *